US006368515B1

(12) United States Patent
Kaminishi et al.

(10) Patent No.: US 6,368,515 B1
(45) Date of Patent: Apr. 9, 2002

(54) METHOD OF MANUFACTURING INK-JET PRINTER HEAD

(75) Inventors: Katsuzo Kaminishi; Junji Shiota; Ichiro Kohno; Kazuyoshi Arai, all of Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/494,117

(22) Filed: Jan. 27, 2000

(30) Foreign Application Priority Data

Feb. 1, 1999 (JP) ..... 11-023376

(51) Int. Cl.[7] ..... B41J 2/16
(52) U.S. Cl. ..... 216/27; 216/33; 216/67
(58) Field of Search ..... 216/27, 33, 67

(56) References Cited

U.S. PATENT DOCUMENTS

| | | | | |
|---|---|---|---|---|
| 4,558,333 A | | 12/1985 | Sugitani et al. | 347/140 R |
| 5,392,064 A | | 2/1995 | Hadimioglu et al. | 347/46 |
| 5,682,187 A | * | 10/1997 | Watanabe et al. | 347/45 |
| 5,912,685 A | * | 6/1999 | Raman | 347/65 |
| 5,949,454 A | * | 9/1999 | Nozawa et al. | 347/45 |

FOREIGN PATENT DOCUMENTS

| | | | |
|---|---|---|---|
| EP | 0 738 603 A | | 10/1996 |
| EP | 0 750 992 A | | 1/1997 |
| GB | 2 302 842 A | | 2/1997 |
| JP | 2000218800 A | * | 8/2000 |
| JP | 2000318170 A | * | 11/2000 |

* cited by examiner

*Primary Examiner*—Anita Alanko
(74) *Attorney, Agent, or Firm*—Frishauf, Holtz, Goodman, Langer & Chick, P.C.

(57) ABSTRACT

In a method of manufacturing an ink-jet printer which uses a thin film sheet having adhesive layers respectively formed on the top and bottom sides, as an orifice plate, orifices are formed in the ink-ejecting side of the thin film sheet after the adhesive layer on that ink-ejecting side has been removed. This prevents the formation of the orifices from being adversely affected by any otherwise residual of the adhesive layer and can thus permit accurate formation of orifices of a desired shape. Even if helicon-wave dry etching which ensure fast etching using high-power energy is used to form orifices, therefore, no adhesive layer is thermally expanded to be a residual so that multiple orifices can be formed simultaneously and quickly.

15 Claims, 10 Drawing Sheets

| STEP NUMBER | CONTENTS |
|---|---|
| 1 | FORMING OXIDE FILM, RESISTOR FILM AND ELECTRODE FILM |
| 2 | FORMING PATTERNS OF RESISTORS AND ELECTRODES |
| 3 | FORMING PARTITION AND INK SEAL |
| 4 | FORMING INK FEED PASSAGE AND INK FEED HOLE |
| 5 | ADHERING ORIFICE PLATE |
| 6 | REMOVING ORIFICE SURFACE LAYER |
| 7 | FORMING METAL FILM AND ORIFICE PATTERN |
| 8 | BORING ORIFICES |
| 9 | DICING |
| 10 | WIRE BONDING |

| STEP NUMBER | CONTENTS |
|---|---|
| ① | FORMING OXIDE FILM, RESISTOR FILM AND ELECTRODE FILM |
| ② | FORMING PATTERNS OF RESISTORS AND ELECTRODES |
| ③ | FORMING PARTITION AND INK SEAL |
| ④ | FORMING INK FEED PASSAGE AND INK FEED HOLE |
| ⑤ | ADHERING ORIFICE PLATE |
| ⑥ | FORMING METAL FILM AND ORIFICE PATTERN |
| ⑦ | BORING ORIFICES |
| ⑧ | DICING |
| ⑨ | WIRE BONDING |

FIG.2
(PRIOR ART)

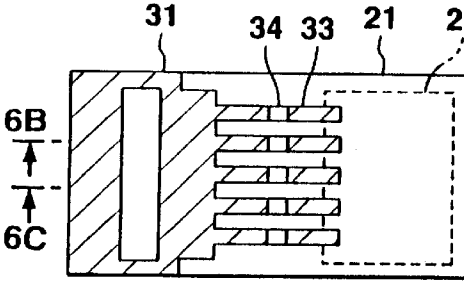
FIG.6A
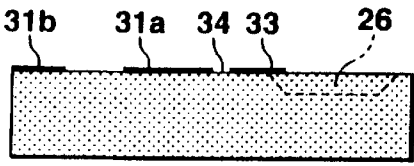
FIG.6B
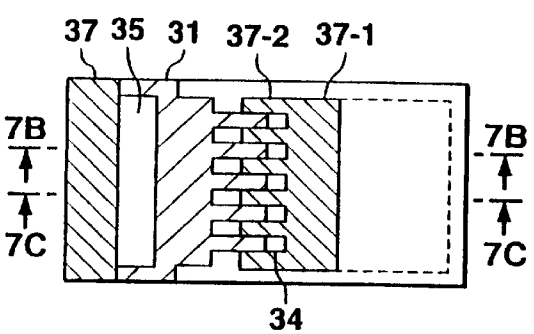
FIG.7A
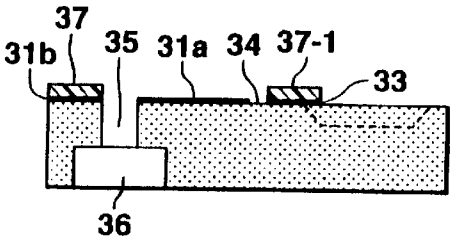
FIG.7B
FIG.8A
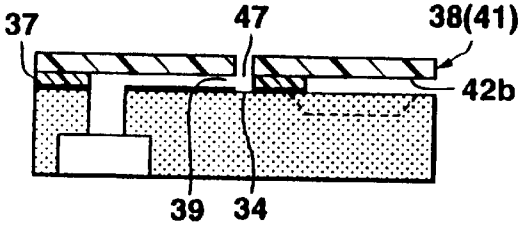
FIG.8B
FIG.7C
FIG.6C
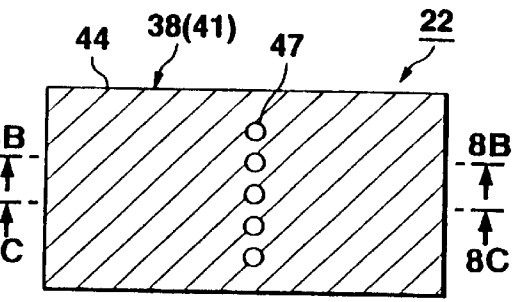
FIG.8C

| STEP NUMBER | CONTENTS |
|---|---|
| 1 | FORMING OXIDE FILM, RESISTOR FILM AND ELECTRODE FILM |
| 2 | FORMING PATTERNS OF RESISTORS AND ELECTRODES |
| 3 | FORMING PARTITION AND INK SEAL |
| 4 | FORMING INK FEED PASSAGE AND INK FEED HOLE |
| 5 | ADHERING ORIFICE PLATE |
| 6 | REMOVING ORIFICE SURFACE LAYER |
| 7 | FORMING METAL FILM AND ORIFICE PATTERN |
| 8 | BORING ORIFICES |
| 9 | DICING |
| 10 | WIRE BONDING |

FIG.9

METHOD OF MANUFACTURING INK-JET PRINTER HEAD

BACKGROUND OF THE INVENTION

1. Field of the Invention

The present invention relates to a method of manufacturing an ink-jet printer head, which has an excellent workability to efficiently and quickly form (bore) good orifices in an orifice plate.

2. Description of the Related Art

Recently, ink-jet printers are widely used. The ink-jet printers include a thermal jet type which ejects ink droplets under the pressure of bubbles that are generated by heating the ink by means of a heat-generating resistor element and a piezoelectric type which ejects ink droplets by pressure that is applied to the ink by the deformation of a piezoelectric resistor element (piezoelectric element).

Because those types of printers do not require a developing step and transfer step and directly eject ink droplets on a recording medium to record information, they are advantageous over an electrophotographic type which uses powder-like toners in easy miniaturization and lower printing energy. The ink-jet printers are therefore popular particularly as personal printers.

The thermal jet type printer heads are classified into two structures depending on the ejection direction of ink droplets: a side-shooter type thermal ink-jet printer head which ejects ink droplets in a direction parallel to the heat generating surface of the heat-generating resistor element and a roof-shooter type or top-shooter type thermal ink-jet printer head which ejects ink droplets in a direction perpendicular to the heat generating surface of the heat-generating resistor element. The roof-shooter type thermal ink-jet printer head, in particular, is known for its very low power consumption.

FIGS. 1A through 1C exemplarily and schematically illustrate the printing principle of the roof-shooter type thermal ink-jet printer head. As shown in FIG. 1A, a heat-generating resistor element 2 is disposed on a silicon substrate 1, and an orifice plate 3 is adhered to an unillustrated partition and is so arranged as to face the silicon substrate 1. A plurality of orifices 4 as ink-ejection nozzles are formed in the orifice plate 3 at a location facing the heat-generating resistor element 2. Unillustrated electrodes are connected to both ends of the heat-generating resistor element 2, and ink 5 is always supplied to an ink flow path in which the heat-generating resistor element 2 is provided.

To eject ink droplets from the orifices 4, first, as shown in FIG. 1B, (1) energizing according to image information heats the heat-generating resistor element 2, thereby causing bubble nucleation on the heat-generating resistor element 2. (2) The generated bubbles are combined to generate a film bubble 6. (3) The film bubble 6 is adiabatically expanded and grown, pressing the nearby ink. This drives ink 5' out of the orifices 4 so that the ink 5' becomes an ink droplet 7 as shown in FIG. 1C which are ejected toward the surface of an unillustrated sheet of paper. (4) As the heat of the grown film bubble 6 is taken by the nearby ink, the film bubble 6 contracts. (5) The film bubble 6 disappears to be ready for the next heating of the heat-generating resistor element 2. This sequence of steps (1) to (5) is performed instantaneously.

One way of manufacturing such a thermal ink-jet printer head is to simultaneously form a plurality of heat-generating resistor elements, drivers for those elements and a plurality of orifices in a monolithic form by utilizing silicon LSI technology and thin film technology.

FIG. 2 presents a table illustrating steps of manufacturing such a thermal ink-jet printer head. As shown in FIG. 2, an oxide film, a resistor film and an electrode film are formed on a substrate in step (1). In step (2), the pattern of heat generating sections and the pattern of electrodes are respectively formed on the resistor film and the electrode film by photolithography or the like. In step (3), a partition is formed which separates the area on the substrate into a predetermined pattern, defining ink flow passages. In step (4), an ink feed passage and an ink feed hole are formed in the substrate. In step (5), an orifice plate is adhered onto the partition.

In step (6), a metal film is formed on the surface of the orifice plate and the pattern of orifices is formed on that metal film. In step (7), orifices are formed using an ordinary dry etching system, excimer laser or the like. In step (8), individual substrates collectively formed on a wafer are separated into individual units by dicing. In step (9), each single head substrate is bonded to a mount substrate with its leads connected to the associated leads thereof. This completes a practical unit of a thermal ink-jet printer head.

In the fabrication of a roof-shooter type thermal ink-jet printer head, the orifice plate should be adhered in such a way as not to bury the ink groove or ink passage formed by the partition with a height of about 10 $\mu$m. While designing this partition to have a height of over 15 $\mu$m eliminates the need for such a concern, the partition cannot be formed to a height of over 15 $\mu$m by single application of a photosensitive resin which is the material for the partition. Applying the photosensitive resin twice however doubles the time for the step of forming the partition, thus lowering the working efficiency.

In addition, a high partition with a height of over 10 $\mu$m makes it difficult to form fine ink flow passages that are needed for a head having a resolution of 400 dpi or greater. In this respect too, the height of the partition should be set to about 10 $\mu$m at a maximum. Normally, an orifice plate which is prepared by applying an adhesive of an epoxy base or the like to a resin of polyimide or the like is adhered onto the partition by thermocompression bonding. This scheme requires that an adhesive should be applied to the thickness of, for example, 5 $\mu$m or less just before usage and should be adhered to the substrate immediately thereafter. It is difficult to apply the adhesive uniformly and thin. Even if application of the adhesive to the thickness of 5 $\mu$m is possible, the ink groove or ink flow passages after adhesion are narrowed to the height of 5 $\mu$m by the adhesive that has been pressed from above by thermocompression bonding, so that part of the ink groove and ink flow passages may be blocked depending on a variation in the thickness of the adhesive.

The conventional scheme has a difficulty in applying an adhesive uniformly and thin and a technical problem on storage after application of the adhesive. It is therefore necessary to perform a work of adhering the orifice plate immediately after application of the adhesive. Further, because the adhesive is sticky, care should be taken to handle the partition applied with the adhesive at the time of adhering the orifice plate, i.e., the workability is not high. Even if polyimide which has a reliably high heat resistance is used for the partition and orifice plate as mentioned above, if an adhesive with a low heat resistance is used, deterioration of the adhesive during use would reduce the high heat-resistance reliability of the partition and orifice plate.

Recently, therefore, the aforementioned orifice plate 3 is acquired by forming an adhesive layer, which consists of a thermoplastic adhesive material having such a high glass transition point as not to flow at room temperature and excellent heat resistance, on the adhesion surface of a very thin polyimide film of about 30 to 40 μm thick which is the essential material. This ensures storage of the orifice plate 3 with the adhesive material applied and allows the orifice plate to be easily adhered to the substrate 1 by thermocompression.

It is to be noted however that this thermoplastic adhesive layer should be adhered to both sides of the orifice plate 3, i.e., not only on the bottom of the orifice plate where the substrate 1 is to be placed but also on the top surface which does not inherently need such adhesion. This is because application of such an adhesive layer only on one side would cause warping or curling due to a difference in the coefficient of thermal expansion between the orifice body and the adhesive layer, making it troublesome to handle the orifice plate 3 and resulting in very poor working efficiency.

The orifice plate with a thickness of 30 to 40 μm, though it is a very thin film member when it is handled, is still thick enough a member to form holes therein by using an ordinary dry etching system or excimer laser. It has therefore been difficult to simultaneously and adequately form multiple orifices in this orifice plate. Conventionally, orifices are formed in the orifice plate, the adequate number at a time, so that forming the whole orifices takes time.

To form multiple orifices at a time, dry etching with helicon wave plasma source (hereinafter referred to as "helicon-wave dry etching") may be used. The helicon wave, which is one type of electromagnetic waves that propagate in plasma, is called a whistler wave and is capable of generating high-density plasma. The use of such a high-density plasma can allow multiple orifices to be simultaneously and accurately form fast and in a predetermined direction.

With the use of the helicon-wave dry etching system, however, the temperature of a target work piece becomes high by the high-density plasma and the orifice plate having thermoplastic adhesive layers adhered to both sides should be used, both of which would raise various problems.

FIG. 3A is a partially enlarged cross-sectional view of a print head before orifices are formed, FIG. 3B is a diagram showing the state where formation of a mask pattern on a metal film is completed, and FIG. 3C is a diagram illustrating a shortcoming which arises at the initial stage of processing orifices by helicon-wave dry etching. As shown in FIG. 3A, the orifice plate 3 has thermoplastic adhesive layers 8*a* and 8*c* adhered to both sides of a polyimide film 8*b*.

In order to form an ink groove 9 and unillustrated ink flow passages and the like, this orifice plate 3 is placed on a partition 11 with that side of the adhesive layer 8*c* facing the substrate 1 and is pressed while being heated to 200 to 300° C. so as to be fixed onto the silicon substrate 1 as shown in FIG. 3A. Thereafter, the orifice plate 3 is placed in the helicon-wave dry etching system and orifices are formed according to a pattern 15.

The orifice plate 3 with the thermoplastic adhesive layers adhered to both sides thereof is an effectively formed member until it is laminated on the substrate 1. When the pattern 15 is formed with a metal mask film 14 formed on the orifice plate 3 and then helicon-wave dry etching is initiated to apply heat, however, corrugation or rising of a thermoplastic adhesive 8*a*' at the center portion as shown in FIG. 3C due to a difference between the coefficient of thermal expansion of the thermoplastic adhesive layer 8*a* at the exposed pattern portion where the metal mask film 14 has been removed prior to the formation (boring) of the orifices and those of the metal mask film 14, the polyimide film 8*b* and the like. In this case, the greater the exposed area of the pattern portion is, the higher the thermoplastic adhesive layer 8*a*' rises at the center portion.

If etching progresses in such a situation, the residual of the thermoplastic adhesive layer 8*a* flows into the ink ejection ports (orifices) so that the ink ejection ports will not be completely round but deformed by the end of the formation of the orifices. At the time of printing, therefore, ink may be ejected in a direction different from the direction it should be ejected, i.e., the direction perpendicular to the surface of the print medium.

Because the opening portions of the holes for connection of bonding wires which correspond to the electrode leads of a drive circuit have relatively large exposed areas, the above phenomenon becomes more noticeable, causing the residual of the thermoplastic adhesive layer 8*a* to remain a lot. This residual of the thermoplastic adhesive layer 8*a* causes bonding defects at the time the ink-jet printer head is wire-bonded to the mount substrate.

In any of the cases discussed above, defects reduce the yield, which leads to a cost increase as well as lower working efficiency.

SUMMARY OF THE INVENTION

Accordingly, it is an object of the present invention to provide a method of manufacturing an ink-jet printer head, which has a high yield and excellent workability and can efficiently and form multiple ejection nozzles of a good quality in a short period of time without having bonding defects or defective ejection nozzles originated from the residual of a thermoplastic adhesive layer even if a thin film sheet which has an excellent workability and has a thermoplastic adhesive layer adhered to either side thereof is used as the base material for an orifice plate.

To achieve the above object, according to one aspect of this invention, a method of manufacturing an ink-jet printer head having a substrate provided with a plurality of energy generating elements for generating pressure energy for ejecting inks and an orifice plate located on the substrate and having a plurality of ejection nozzles formed therein for ejecting inks in a predetermined direction by pressure generated by the energy generating elements comprises the steps of preparing a thin film sheet material having adhesive layers respectively formed on top and bottom sides, as a material of the orifice plate; removing that one of the adhesive layers which is on an ink-ejecting-side surface of the thin film sheet material; forming an etching mask film on the ink-ejecting-side surface of the thin film sheet material from which the one of the adhesive layers has been removed; forming a pattern corresponding to the plurality of ejection nozzles on the mask film; and forming the plurality of ejection nozzles by dry etching in accordance with the pattern.

According to the above manufacturing method for an ink-jet printer head, the adhesive layers are not thermally expanded at the time of etching and does not adversely affect the etching process. Nor do the adhesive layers remain as a residual after etching. This can prevent bonding defects or defective orifices from being made by such a residual. Further, this method can permit the use of a helicon-wave dry etching system which can implement fast etching with the high-energy ion current, thus making it possible to form a plurality of uniform orifices quickly.

In this manufacturing method, removing of the one of the adhesive layers may be carried out after the thin film sheet material is placed on the substrate or before the thin film sheet material is placed on the substrate. In the latter case, it is preferable that the mask film is formed on the thin film sheet material while the thin film sheet material is being fed between a pair of take-up rolls. This further improves the working efficiency.

In this manufacturing method, the adhesive layers are preferably of a thermoplastic type and more preferably are thermoplastic adhesive layers which have a glass transition point of 150° C. or higher.

Further, in the manufacturing method, it is preferable that the mask film is a multilayer mask film having a water repellent composite film, comprised of a water repellent material and metal, and a metal film and that orifices are formed after this mask film is formed on the orifice plate. This modification prevents a plating deposit, which is produced when the composite film is electroplated after forming the orifices, from being adhered to the interior of the head, and improves the yield more. As the water-repellent film can be formed together with the mask film, the working efficiency is increased significantly.

Furthermore, in the manufacturing method, it is preferable that the dry etching is helicon-wave dry etching in view of simultaneous and efficient forming of multiple orifices of the desired shape as mentioned above, or that removing of one of the adhesive layers is carried out by dry etching such as a resist asher.

In addition, the above manufacturing method can effectively be adapted, particularly, to a thermal ink-jet printer in which the energy generating elements are heat generating elements for heating inks to generate bubbles, thereby causing the inks to be ejected.

To achieve the aforementioned object, according to another aspect of this invention, a method of manufacturing an ink-jet printer head having a substrate provided with a plurality of energy generating elements for generating pressure energy for ejecting inks and an orifice plate located on the substrate and having a plurality of ejection nozzles formed therein for ejecting inks in a predetermined direction by pressure generated by the energy generating elements comprises the steps of preparing a thin film sheet material having adhesive layers respectively formed on top and bottom sides, as a material of the orifice plate; placing the thin film sheet material on the substrate; removing that one of the adhesive layers which is on an ink-ejecting-side surface of the thin film sheet material placed on the substrate; and forming the plurality of ejection nozzles by etching on the ink-ejecting-side surface of the thin film sheet material from which the one of the adhesive layers has been removed.

In this manufacturing method, it is likewise preferable that the adhesive layers are of a thermoplastic type. This manufacturing method is particularly effective when it is adapted to a case of forming a plurality of ejection nozzles by helicon-wave dry etching.

Moreover, to achieve the aforementioned object, according to a further aspect of this invention, a method of manufacturing an ink-jet printer head having a substrate provided with a plurality of energy generating elements for generating pressure energy for ejecting inks and an orifice plate located on the substrate and having a plurality of ejection nozzles formed therein for ejecting inks in a predetermined direction by pressure generated by the energy generating elements comprises the steps of preparing a thin film sheet material having adhesive layers respectively formed on top and bottom sides, as a material of the orifice plate; removing that one of the adhesive layers which is on an ink-ejecting-side surface of the thin film sheet material; and forming the plurality of ejection nozzles on the ink-ejecting-side surface of the thin film sheet material from which the one of the adhesive layers has been removed.

BRIEF DESCRIPTION OF THE DRAWINGS

These objects and other objects and advantages of the present invention will become more apparent upon reading of the following detailed description and the accompanying drawings in which:

FIG. 2 is a table illustrating steps of manufacturing a conventional thermal ink-jet printer head;

FIGS. 6A through 6C are respectively a plan view exemplarily showing the thermal ink-jet printer head in enlargement when the step of FIG. 5B is completed, a cross-sectional view from the direction of 6B–6B in FIG. 6A and a cross-sectional view from the direction of 6C–6C in FIG. 6A;

FIGS. 7A through 7C are respectively a plan view exemplarily showing the thermal ink-jet printer head in enlargement when the partition forming step is completed, a cross-sectional view from the direction of 7B–7B in FIG. 7A and a cross-sectional view from the direction of 7C–7C in FIG. 7A;

FIGS. 8A through 8C are respectively a plan view, exemplarily showing the thermal ink-jet printer head in enlargement when the step of FIG. 5D is completed, a cross-sectional view from the direction of 8B–8B in FIG. 8A and a cross-sectional view from the direction of 8C–8C in FIG. 8A;

FIG. 9 is a table illustrating steps of manufacturing the ink-jet printer head according to the first embodiment of this invention;

DETAILED DESCRIPTION OF THE PREFERRED EMBODIMENTS

Preferred embodiments of the present invention will now be described with reference to the accompanying drawings.

Figure 4A:
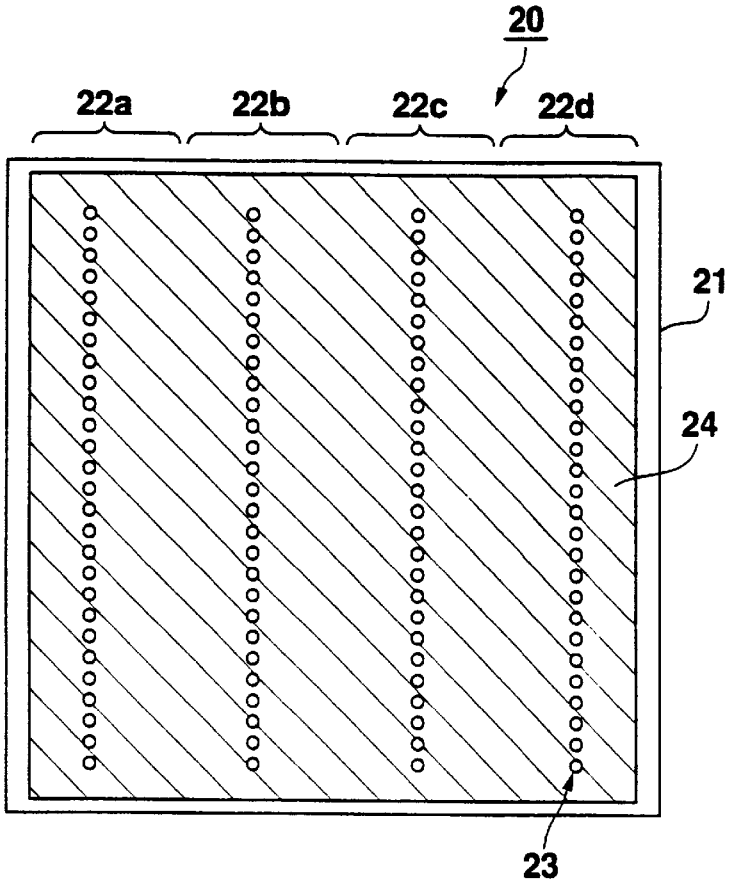
FIG. 4A is a plan view showing the overall thermal ink-jet printer head according to a first embodiment of this invention.
Figure 4B:
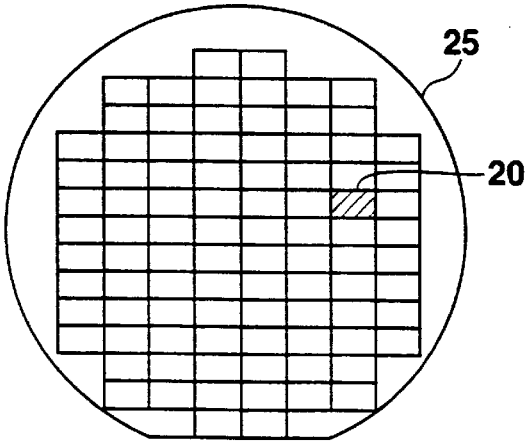
FIG. 4B is a plan view showing multiple heads of the same type formed on a silicon wafer.

FIG. 4A is a plan view showing a full-color thermal ink-jet printer head (hereinafter simply called "color head") according to a first embodiment, and FIG. 4B is a plan view showing multiple heads of the same type formed on a silicon wafer. The color head 20 shown in FIG. 4A has four unit heads 22*a*, 22*b*, 22*c* and 22*d* arranged in parallel on a relatively large substrate 21.

Each of the unit heads 22*a*–22*d* has a column of multiple orifices (hereinafter referred to as "orifice column") 23, formed on its own orifice plate 24, a total four orifice columns 23 in the whole color head 20. Those orifice columns 23 respectively eject inks of three colors, yellow (Y), magenta (M and cyan (C), which are the three subtractive primaries, and a black (B) ink exclusively used for characters and black portions of an image, in order from, for example, right to left.

With a resolution of 360 dpi, for example, the color head 20 has 128×4=524 orifices formed on a chip having a size of approximately 8.5 mm×19.0 mm. With a resolution of 720 dpi, the color head 20 has 256×4=1024 orifices on a chip having a size of approximately 8.5 mm×19.0 mm.

As shown in FIG. 4B, the substrates of multiple (e.g., more than 90) color heads 20 are defined on a single silicon wafer 25 by scribe lines, and are completed as shown in FIG. 4A through manufacturing steps to be discussed later, after which the color heads 20 will be diced.

FIGS. 5A through 5D are plan views for explaining a method of manufacturing the color head 20 step by step, and exemplarily and schematically illustrate a unit head which is formed on the substrate of a silicon chip in a sequence of steps. Although FIG. 5D exemplifies 21 orifices 47, 128 or 256 orifices are actually arranged in a line as mentioned above.

FIGS. 6A, 7A and 8A are plan views exemplarily showing the essential portions, in partial enlargement, in the individual stages in the sequence of manufacturing steps, FIGS. 6B, 7B and 8B are cross-sectional views 6B–6B, 7B–7B and 8B–8B, respectively, in the first three diagrams, and FIGS. 6C, 7C and 8C are cross-sectional views 6C–6C, 7C–7C and 8C–8C, respectively, in the first three diagrams. FIGS. 6A–8C show five individual ink flow passages as a representative of those associated with 128 or 256 orifices for the sake of illustrative convenience.

FIG. 9 presents a table illustrating the contents of the steps of manufacturing the color head 20. As apparent from FIG. 9, this embodiment has steps greater in number by one than the conventional steps shown in FIG. 2.

Figure 5D:
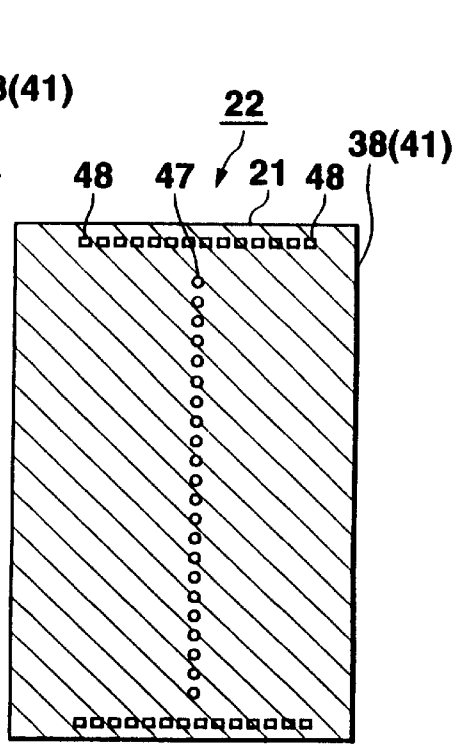
FIGS. 5A through 5D are plan views illustrating a method of manufacturing the thermal ink-jet printer head in FIG. 4A step by step.
Figure 5C:
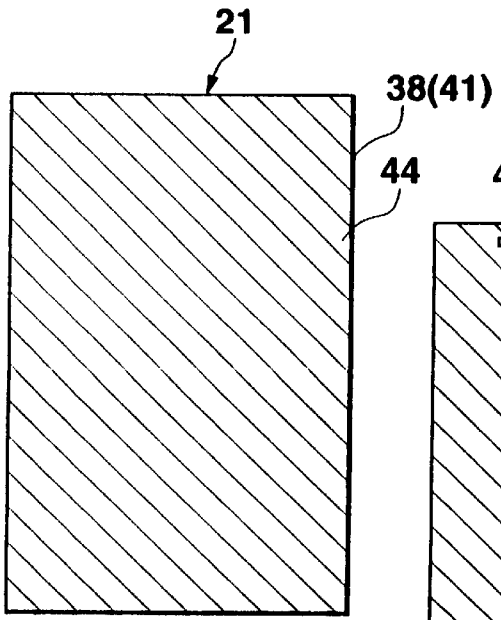
Figure 5B:
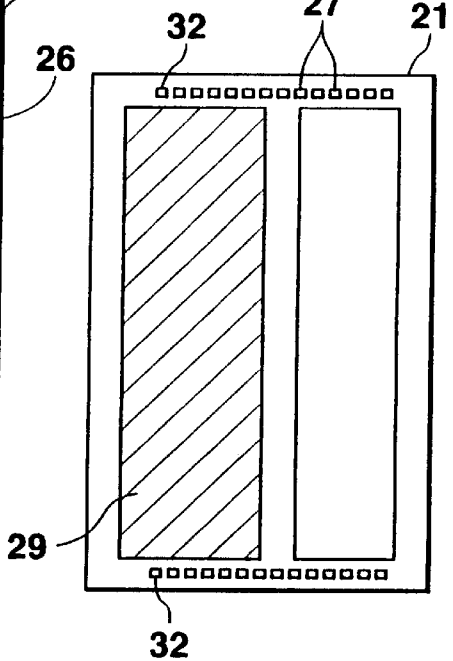
Figure 5A:
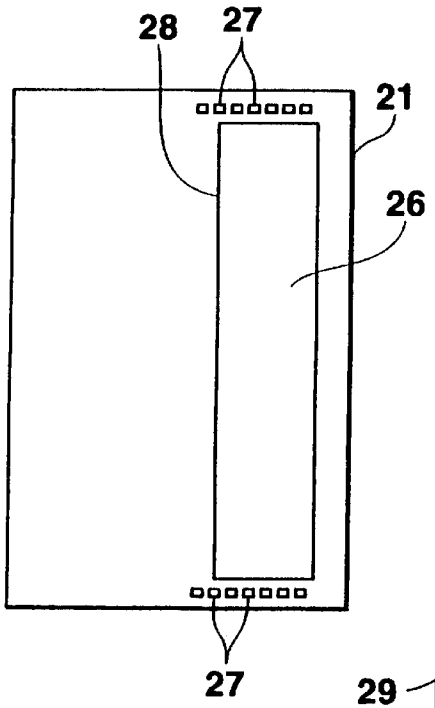

First, as a preparation step, a drive circuit 26 having electrode wirings and its leads 27 are formed on the substrate 21 by LSI technology, as shown in FIG. 5A.

Next, in step 1 shown in FIG. 9, an oxide film 28 is formed nearly on the entire surface of the substrate 21 excluding the leads 27 thereon as shown in FIG. 5A, and a resistor film (not shown) of Ta—Si—O or the like for forming heat generating elements is formed 40 nm thick on the resultant structure by using thin film deposition technology such as sputtering. As shown in FIG. 5B, an electrode film 29 for forming a common electrode and individual wiring electrodes is then form on the substrate 21. It is preferable that this electrode film 29 has a multilayer structure having an electrode film of Au formed on a barrier metal layer of W—Al (or W—Ti, W—Si) or the like.

In subsequent step 2, the electrode film 29 and the resistor film are patterned in order into predetermined shapes by photolithography technology. As a result, heat generating elements of a stripe shape having exposed portions of the resistor film of, for example, a substantially square shape as heat generating sections are formed in parallel by the number of dots that is designed for that head. In this step, the positions of the heat generating sections are aligned.

FIGS. 6A through 6C show the state immediately after the step 2 has been completed. That is, a common electrode 31 (31*a*, 31*b*) and common-electrode power-supply leads 32 (see FIG. 5B), individual wiring electrodes 33 and multiple heat generating sections 34 are formed on the substrate 21.

In step 3, a partition material of an organic material such as photosensitive polyimide is applied to the thickness of about 20 μm by coating in order to form a partition which defines individual ink flow passages associated with the individual heat generating sections 34 and a common ink flow passage. After patterning the partition material, curing (annealing) is carried out to apply heat of 300° C. to 400° C. to the substrate 21 for 30 to 60 minutes or 2 hours in some case. After being cured, the partition of photosensitive polyimide having a height of 10 μm is formed on the substrate 21.

In the next step 4, an ink feed groove is formed in the surface of the substrate by wet etching, sand blasting or the like, followed by the formation of an ink feed hole which communicates with this ink feed groove and is open to the bottom of the substrate 21.

FIGS. 7A through 7C show the state immediately after the steps 3 and 4 have been completed. Specifically, an ink feed groove 35 and ink feed hole 36 are formed in the thickness direction of the substrate in such a way as to communicate with each other, and a partition 37 is formed on the substrate 21 at a predetermined position, thereby defining the ink flow passages. The partition 37 has a seal portion 37-1, which may appear as the spine of a comb, over the individual wiring electrodes 33 and a partitioning portion 37-2 which extends between the individual heat generating sections 34 in the shape of teeth of that comb. With the teeth of the comb as partitioning walls, ultra fine ink flow passages with the heat generating sections 34 located at the bases between the teeth are formed in the same quantity as the number of the heat generating sections 34. The length of the teeth of the comb influences not only the conductance when inks flow through the ink flow passages but also the degree of interference between the inks that flow in the adjoining ink flow passages.

In subsequent step 5, a film-like orifice plate of polyimide of 10 to 40 μm in thickness which has an ultra thin film of thermoplastic polyimide as an adhesive layer coated to the thickness of, for example, 2 to 5 μm on each side is adhered to the topmost layer of the lamination structure, thereby covering the ink flow passages formed by the seal portion 37-1 and partitioning portion 37-2 of the partition 37. Pressure is applied to the resultant structure while heating it at 200 to 300° C., thereby fixing the orifice plate. As a result, covered tunnel-like ink flow passages are formed.

Figure 10A:
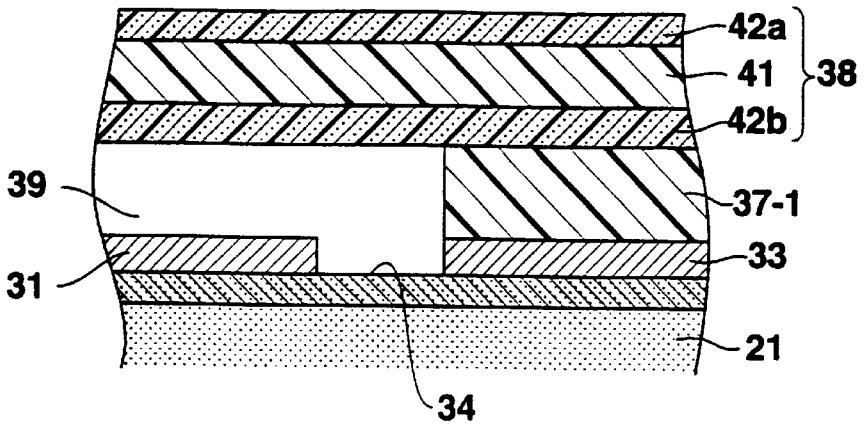
FIGS. 10A through 10C are cross-sectional views showing the thermal ink-jet printer head respectively when step 5, step 6 and step 7 in the fabrication steps illustrated in FIG. 9 are finished.
Figure 10B:
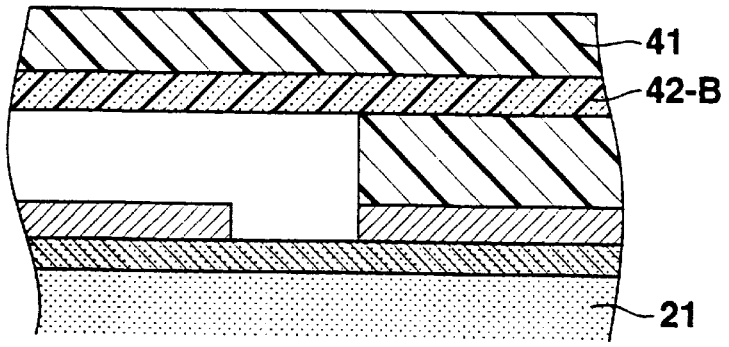
Figure 10C:
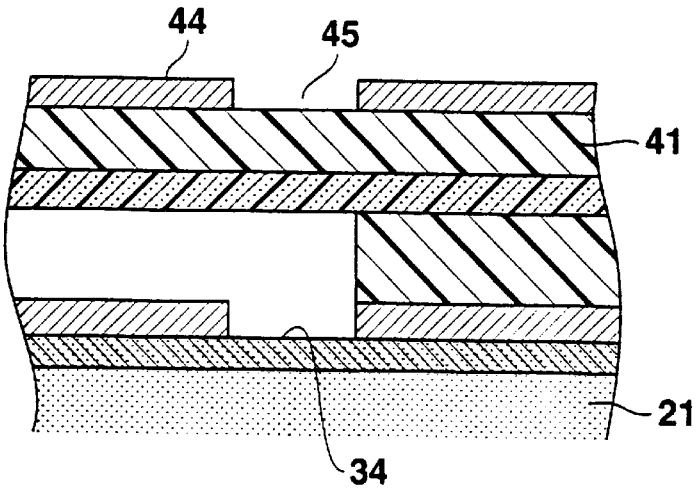

FIG. 10A shows the state right after the step 5 is completed, and FIGS. 10B and 10C show steps following the step 5. As shown in FIG. 10A, as an orifice plate 38 is laminated, tunnel-shaped ink flow passages 39 corresponding to the heat generating sections 34 are formed. The orifice plate 38 is formed by coating of polyimide and 10 to 40 μm in thickness which has ultra thin film of thermoplastic polyimide adhesive layers 42*a* and 42*b* coated to the thickness of 2 to 5 μm on the respective sides of a polyimide film 41 having a thickness of approximately 25 μm.

For the thermoplastic polyimide adhesive layers 42*a* and 42*b*, thermoplastic polyimide having a glass transition point of 150° C. or higher is used and is coated into a very thin film. Adhesion of the adhesive layers to both sides of the orifice plate 38 makes it difficult to warp or curl the orifice plate 38, thus making it easier to handle the orifice plate 38. The polyimide film with a thermoplastic material having a high glass transition point coated on both sides is placed on the partition and is pressed under a pressure of several tens of kg/cm$^2$ for several tens of minutes while it is being heated to a temperature equal to or higher than the glass transition point of the thermoplastic material, so that the polyimide film is cured. The preferable conditions for this thermocompression step are, for example, at 150° C. to 240° C. under 19 kg/cm$^2$ for the press time of 30 minutes.

At or higher than 150° C. which is the glass transition point, the elastic modulus of the thermoplastic polyimide adhesive layer 42*b* decreases while, at the same time, the adhesive property appears. At room temperature, the thermoplastic polyimide adhesive layer 42*b* shows no adhesiveness and a good storage property, and is stable and easy to handle, though adhesion of moisture should be avoided. It is therefore possible to store orifice plates with a thermoplastic polyimide adhesive coated on each side and cut out the necessary portion at the time of usage.

In step 6 shown in FIG. 9, the thermoplastic polyimide adhesive layer 42*a* located on the orifice plate shown in FIG. 10A on the opposite side (ink ejecting side) to the substrate 21 is removed. This thermoplastic polyimide adhesive layer 42*a* is removed by isotropic etching using an ordinary organic-film etching system such as a simple resist asher, under the environment of oxygen plasma. Specifically, after the orifice plate 38 is adhered to the substrate 21, the thermoplastic polyimide adhesive layer 42*a* on the top surface can be removed easily by etching with oxygen asher of about 1 kW for 5 to 10 minutes alone.

In the next step 7, a metal film of Ni Cu, Al or the like is formed to the thickness of about 0.5 to 1 $\mu$m on the polyimide film 41 whose surface is exposed as the thermoplastic polyimide 42*a* of the orifice plate 38 has been removed, and this metal film is then patterned, thereby forming a mask for selective etching of the orifice plate 38 to form orifices.

FIG. 5C shows the state immediately after the metal film is formed in the step 7, in which the orifice plate 38 is laminated on the topmost layer of the substrate 21, covering the entire surface, with a metal mask film 44 formed on the top of the orifice plate 38. A pattern 45 is formed on the metal mask film 44 at positions corresponding to the heat generating sections 34 as shown in FIG. 10C. Further, a pattern is likewise formed at positions corresponding to the leads on the printer head side, such as the leads 27 of the drive circuit 26 and the common-electrode power-supply lead 32 shown in FIG. 5B.

Then, in step 8, the orifice plate 38 is subjected to dry etching according to the metal mask film 44 using the helicon-wave dry etching system, thereby simultaneously forming multiple orifices of 40 $\mu$m$\phi$ to 20 $\mu$m$\phi$ as well as contact holes 48 corresponding to the leads on the printer head side, such as the leads 27 of the drive circuit 26 and the common-electrode power-supply lead 32.

Figure 1A:
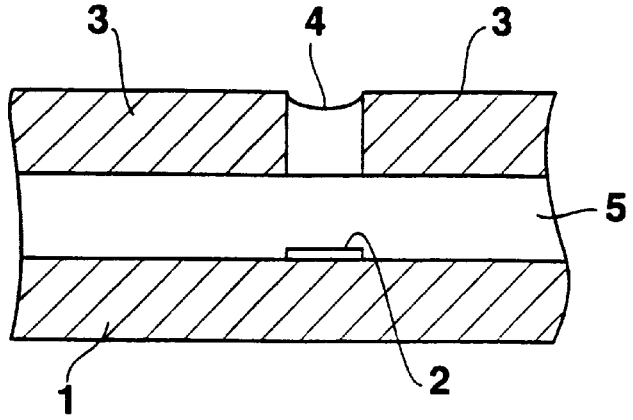
FIG.1A (PRIOR ART)
FIGS. 1A through 1C are explanatory diagrams exemplarily and schematically illustrating the printing principle of a roof-shooter type thermal ink-jet printer head step by step.
Figure 1B:
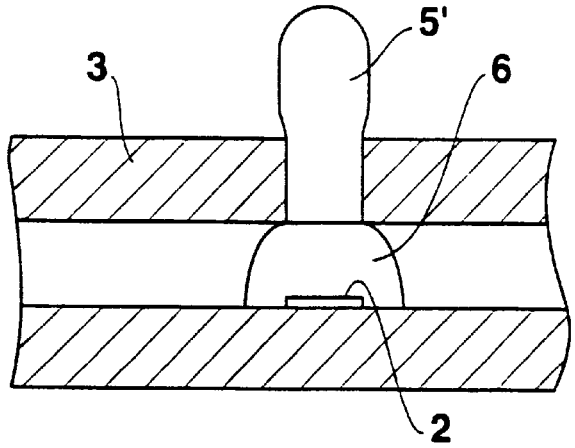
FIG.1B (PRIOR ART)
Figure 1C:
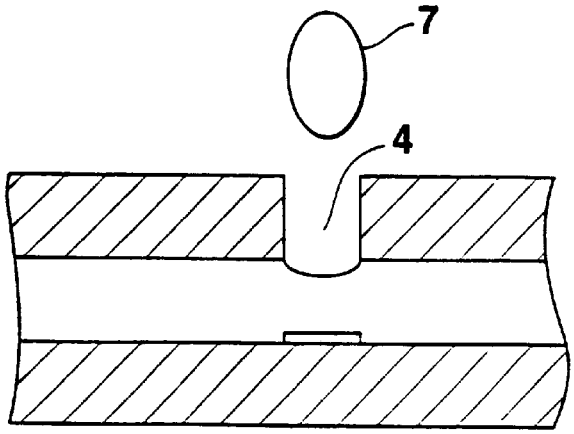
FIG.1C (PRIOR ART)
Figure 3A:
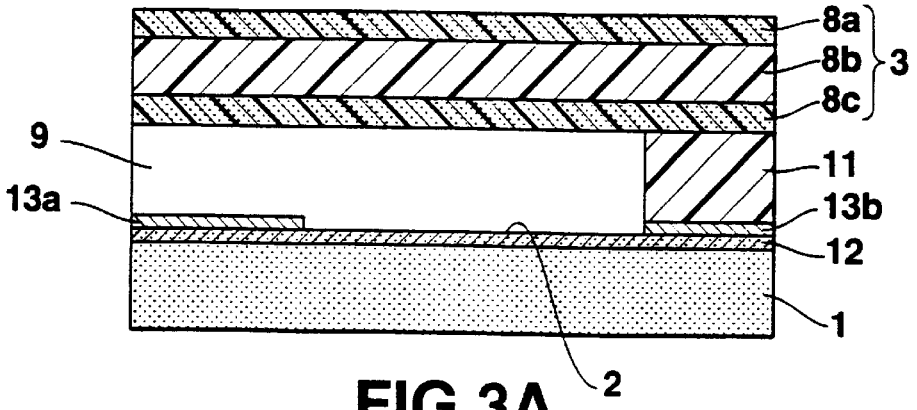
FIG.3A (PRIOR ART)
FIGS. 3A, 3B and 3C are explanatory cross-sectional views illustrating the conventional step of forming orifices step by step.
Figure 3B:
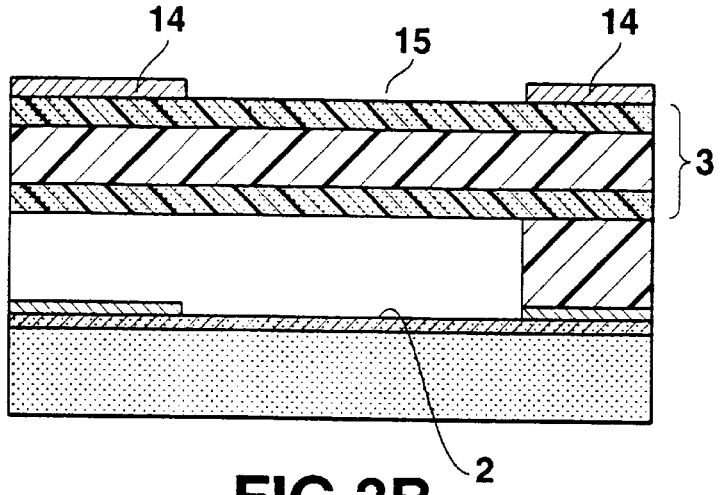
FIG.3B (PRIOR ART)
Figure 3C:
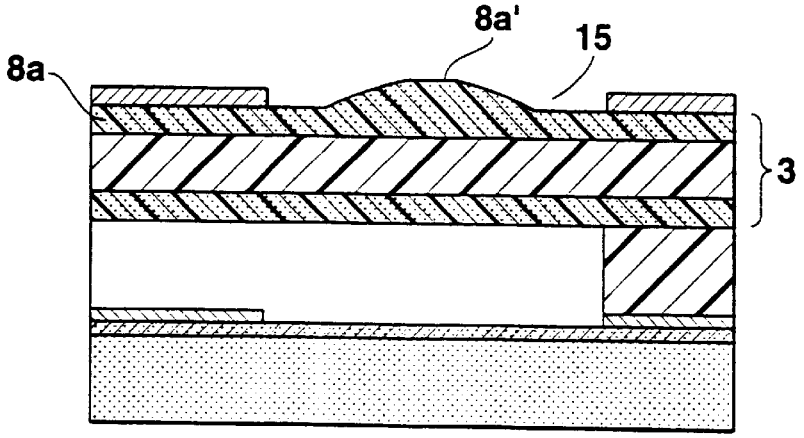
FIG.3C (PRIOR ART)

According to this embodiment, after removal of the thermoplastic polyimide 42*a* on the surface side of the orifice plate 38 where ink ejection ports are to be formed, forming the orifices 47 and contact holes 48 is started from this surface side by dry etching, so that etching of the polyimide film 41 of the main body of the orifice plate starts from the beginning. Even if the overall temperature of the orifice plate 38 rises at the time of etching, unlike in the prior art (see FIG. 3C), the thermoplastic polyimide adhesive layer 42*a* on the top surface is not thermally expanded to be a residual before dry etching is performed on the polyimide film 41 of the main body of the orifice plate and does not thus adversely affect the etching of the polyimide film 41 of the main body of the orifice plate thereafter. Consequently, uniform dry etching is performed on the polyimide film 41 of the main body of the orifice plate, allowing multiple orifices of the desired shape to be formed simultaneously.

FIG. 5D and FIGS. 8A–8C show the state immediately after step 8 is completed. The individual stake-like ink flow passages 39 having the same height as the thickness of the partition 37 of 10 $\mu$m and the common ink feed passage 46 which connects the individual ink flow passages 39 to the ink feed groove 35 are formed by the orifice plate 38 which has covered the entire area of the substrate 21. The orifices 47 for ink ejection which have the adequately perfect circular cross section at the position where it faces the heat generating section 34 to which inks are supplied from the common ink flow passage 46. The contact holes 48 (see FIG. 5D) having the desired, normal shape are likewise formed at positions corresponding to the leads on the printer head side, such as the leads 27 of the drive circuit and the common-electrode power-supply lead 32 shown in FIG. 5B.

In the above-described manner, a unit head 22 having one column of nozzle holes (orifices) 47 is completed The thermal ink-jet printer head 20 shown in FIG. 4A has four of such unit heads 22 arranged in parallel to one another in sequence.

The process up to this step has been carried out with respect to the silicon wafer 25 in the state shown in FIG. 4B. In the next step 9, the unit heads are separated for each thermal ink-jet printer head 20 by a dicing saw. Then, the connection leads are wire-bonded to the connection leads on a master substrate or the like, completing the printer head in the step 10.

According to the above-described manufacturing method, after the orifice plate is placed on the substrate on which the heat generating elements are provided, mask alignment is carried out for formation of orifices, the alignment precision is improved considerably as compared with the method that adheres an orifice plate which has previously undergone orifice processing to the substrate later.

A second embodiment of this invention will now be discussed.

Although removal of the top adhesive layer (thermoplastic polyimide 42*a*) located on the orifice plate 38 on the opposite side to the substrate 21 is performed after the orifice plate 38 is placed on the substrate 21, removal of the top adhesive layer is not limited to this particular mode but it may be performed before the orifice plate 38 is laminated on the substrate 21. This mode will be explained as the second embodiment.

Figure 11A:
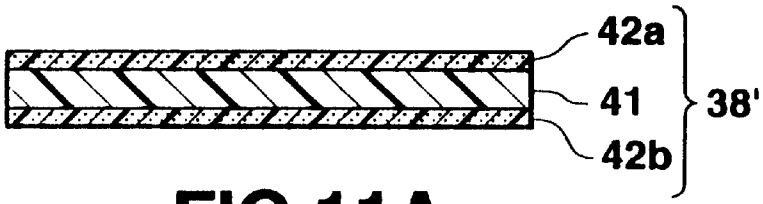
FIGS. 11A through 11C are explanatory diagrams exemplarily illustrating how to process an orifice plate in a method of manufacturing an ink-jet printer head according to a second embodiment of this invention.
Figure 11B:
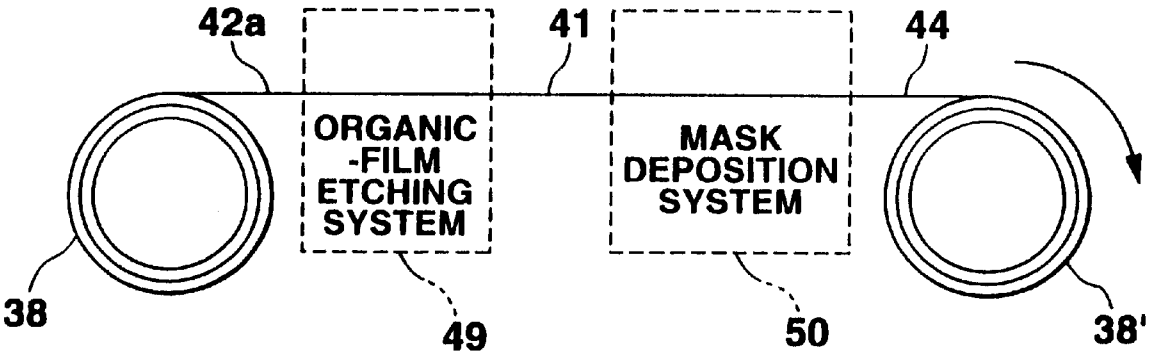
Figure 11C:
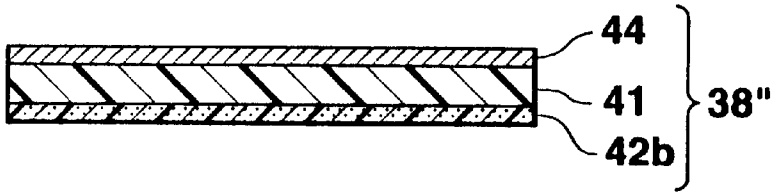

FIGS. 11A through 11C are diagrams exemplarily illustrating how to process an orifice plate according to the second embodiment. In this case, a sheet 38' for orifice plates is likewise constructed by laminating thermoplastic polyimide adhesive layers 42*a* and 42*b* having a high glass transition point on both sides of the polyimide film 41 as shown in FIG. 11A.

The sheet 38' for orifice plates is stored in a roll form as shown on the left-hand side in FIG. 11B and is taken up in a roil as shown in the right-hand side in FIG. 11B. During this processing, the thermoplastic polyimide adhesive layer 42*a* at the top is removed in an ordinary organic-film etching system 49, such as the aforementioned simple resist asher, the metal mask film 44 is adhered to the surface of the sheet 38' from which the adhesive layer 42*a* is removed by a mask deposition system 51 located at the succeeding stage.

In this manner, a sheet 38" for orifice plates, which has the metal mask film 44 adhered as shown in FIG. 11C is prepared and taken up in a roll on the right-hand side in FIG. 11B. Because this orifice-plates sheet 38" is rolled, it is easy to store and handle.

Further, a jig for the substrate 21 is arranged under the space between the mask deposition system 50 and the take-up roil and a punching machine is arranged above it to punch out the orifice sheet 38" adhered with the metal mask film 44, thereby placing orifice plates on the substrate 21. Performing the process after the second half of the step 7 as mentioned in the first embodiment results in an improved manufacturing efficiency.

A third embodiment of this invention will now be described.

In the above-described steps, generally, after holes are formed in the orifice plate, the metal film (e.g., Ni) that has been used as a mask in forming the holes is subjected to so-called composite plating which plates the metal film with minute particles of fluorocarbon resin, graphite fluoride or the like dispersed in an Ni plating liquid. This treatment adds water repellency and improves hydrophobicity with respect to the inks on the ejection-side surface of the orifice plate (particularly, the surface around the orifices), thus ensuring smoother dropping of ink droplets to be ejected.

As such composite plating with minute particles of fluorocarbon resin or the like is basically electroless plating, it is difficult to remove deposits which are adhered to the ink ejection ports of the orifices, fine ink flow passages or other portions from the plating liquid as the entire substrate 21 is dipped in the plating liquid after the formation of the minute orifices.

As the rolling process allows the metal mask film 44 to be adhered to the orifice plate as in the case of the orifice sheet 38" before it is placed on the substrate 21, however, adhesion of the metal film and a process of adding water repellency can be performed at the same time. This advantageously eliminates the need for execution of composite plating after forming orifices. This mode will be discussed as the third embodiment.

Figure 12A:
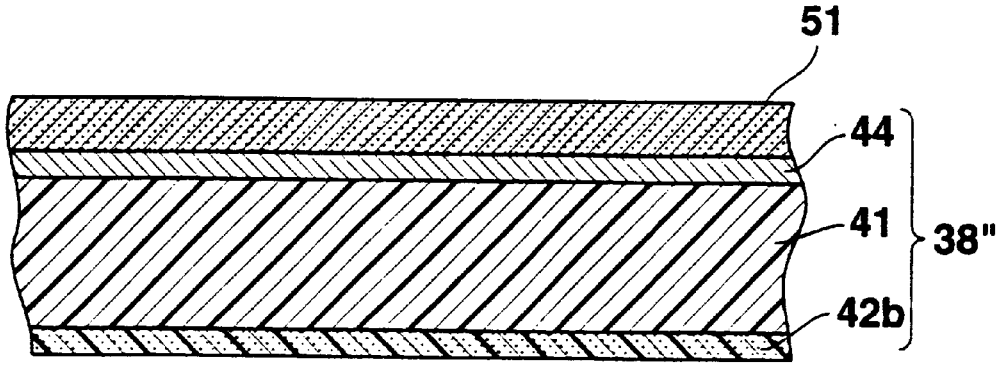
FIGS. 12A through 12C are enlarged cross-sectional views showing steps of processing an orifice plate in a method of manufacturing an ink-jet printer head according to a third embodiment of this invention.
Figure 12B:
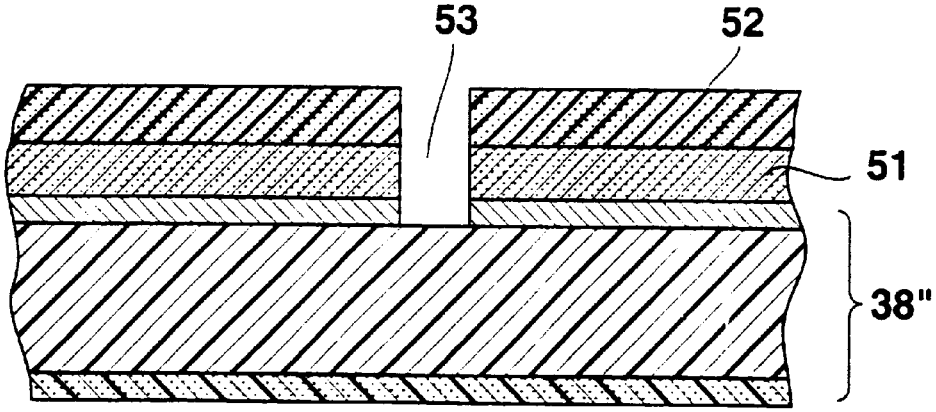
Figure 12C:
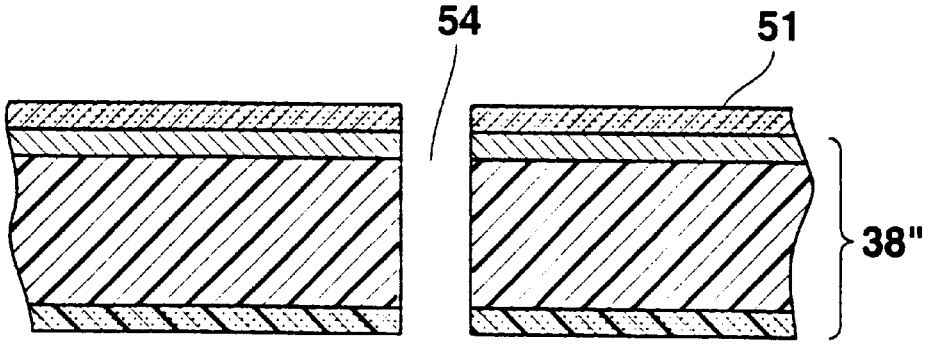

FIGS. 12A and 12B show a step immediately before formation of holes in the orifice plate according to the third embodiment, and FIG. 12C shows the state after the orifices are formed. As shown in FIG. 12A, the metal mask film 44 of Cu or Ni is formed 200 nm thick on the orifice sheet 38" having a length of several tens of meters by vacuum deposition in the manner discussed earlier.

This structure is further subjected to plating with a mixture of an Ni plating liquid or the like minute particles of fluorocarbon resin, graphite fluoride or the like dispersed therein, which can add water repellency, thereby forming a composite plated film 51. While this composite plated film 51 has water repellency, its etching ratio for forming orifices is relatively low so that for the composite plated film 51 to remain on the surface with the required thickness of about 0.1 to 0.2 $\mu$m after etching, the composite plated film 51 should be formed to the thickness of about 0.5 to 0.6 $\mu$m, considerably thicker than 0.1 to 0.2 $\mu$m.

However, this third embodiment can avoid the use of a large amount of an expensive, water repellent composite plating liquid and forms the composite plated film 51 as thin as the required thickness of about 0.1 to 0.2 $\mu$m in order to quicken the time for the composite plating that takes more time than metal-only plating. In addition, to improve the etching ratio, a surface mask film 52 is plated with ordinary, inexpensive Ni or Cu to the thickness of about 0.3 $\mu$m, yielding a mask film having a triple-layer structure as shown in FIG. 12B.

An orifice pattern 53 is formed on the resultant structure, and is then etched fast using this mask film having a triple-layer structure and helicon-wave dry etching with oxygen plasma. As a result, the surface mask film 52 is etched out completely by the time forming orifices 54 is completed, as shown in FIG. 12C. Although the composite plated film 51 is etched a little, the film thick enough as a surface water repellent layer of the orifice plate can be left on the surface. Accordingly, the ink ejecting side after the formation of the orifices 54 is finished can be provided with water repellency without being subjected to a special treatment.

It is to be noted that the adhesive layer to be adhered to each side of a thin film sheet is not limited to a thermoplastic type, but may be thermosetting type as well. The above-described manufacturing methods are not limited to thermal ink-jet printer heads which use heat generating elements as pressure-energy generating elements, but may suitably be adapted to piezoelectric type ink-jet printer heads which use piezoelectric elements.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. H11-23376 filed on Feb. 1, 1999 and including specification, claims, drawings and summary. The disclosure of the above Japanese Patent Application is incorporated herein by reference in its entirety.

What is claimed is:

1. A method of manufacturing an ink-jet printer head having a substrate provided with a plurality of energy generating elements for generating pressure energy for ejecting inks and an orifice plate located on said substrate and having a plurality of ejection nozzles formed therein for ejecting inks in a predetermined direction by pressure generated by said energy generating elements, said method comprising the steps of:

preparing a thin film sheet material having adhesive layers respectively formed on top and bottom sides, as a material of said orifice plate;

removing one of said adhesive layers which is on an ink-ejecting-side surface of said thin film sheet material;

forming an etching mask film on said ink-ejecting-side surface of said thin film sheet material from which said one of said adhesive layers has been removed;

forming a pattern corresponding to said plurality of ejection nozzles on said mask film; and forming said plurality of ejection nozzles by dry etching in accordance with said pattern.

2. The method according to claim 1, wherein said removing of said one of said adhesive layers is carried out after said thin film sheet material is placed on said substrate.

3. The method according to claim 1, wherein said removing of said one of said adhesive layers is carried out before said thin film sheet material is placed on said substrate.

4. The method according to claim 3, wherein said forming of said mask film is performed before said thin film sheet material is placed on said substrate.

5. The method according to claim 4, wherein said mask film is formed on said thin film sheet material while said thin film sheet material is being fed between a pair of take-up rolls.

6. The method according to claim 1, wherein said adhesive layers are of a thermoplastic type.

7. The method according to claim 6, wherein said thermoplastic adhesive layers have a glass transition point of 150° C. or higher.

8. The method according to claim 1, wherein said mask film is a multilayer mask film having a water repellent composite film, comprised of a water repellent material and metal and a metal film.

9. The method according to claim 1, wherein said dry etching is helicon-wave dry etching.

10. The method according to claim 1, wherein said one of said adhesive layers is removed by dry etching.

11. The method according to claim 1, wherein said energy generating elements are heat generating elements for heating inks to generate bubbles, thereby causing said inks to be ejected.

12. A method of manufacturing an ink-jet printer head having a substrate provided with a plurality of energy generating elements for generating pressure energy for ejecting inks and an orifice plate located on said substrate and having a plurality of ejection nozzles formed therein for ejecting inks in a predetermined direction by pressure generated by said energy generating elements, said method comprising the steps of:

preparing a thin film sheet material having adhesive layers respectively formed on top and bottom sides, as a material of said orifice plate;

placing said thin film sheet material on said substrate;

removing one of said adhesive layers which is on an ink-ejecting-side surface of said thin film sheet material placed on said substrate; and forming said plurality of ejection nozzles by etching on said ink-ejecting-side surface of said thin film sheet material from which said one of said adhesive layers has been removed.

13. The method according to claim 12, wherein said adhesive layers are of a thermoplastic type.

14. The method according to claim 12, wherein said dry etching is helicon-wave dry etching.

15. A method of manufacturing an ink-jet printer head having a substrate provided with a plurality of energy generating elements for generating pressure energy for ejecting inks and an orifice plate located on said substrate and having a plurality of ejection nozzles formed therein for ejecting inks in a predetermined direction by pressure generated by said energy generating elements, said method comprising the steps of:

preparing a thin film sheet material having adhesive layers respectively formed on top and bottom sides, as a material of said orifice plate;

removing one of said adhesive layers which is on an ink-ejecting-side surface of said thin film sheet material; and forming said plurality of ejection nozzles on said ink-ejecting-side surface of said thin film sheet material from which said one of said adhesive layers has been removed.

* * * * *